US005435040A

United States Patent [19]

McClure

[11] Patent Number: 5,435,040

[45] Date of Patent: Jul. 25, 1995

[54] CLEANING UTENSIL

[76] Inventor: Jennie L. McClure, 1622 Meadow Way, Garland, Tex. 75042

[21] Appl. No.: 349,123

[22] Filed: Dec. 1, 1994

Related U.S. Application Data

[63] Continuation of Ser. No. 146,799, Nov. 1, 1993, abandoned.

[51] Int. Cl.[6] ..... A47L 13/46

[52] U.S. Cl. ..... 15/244.1; 15/144.4

[58] Field of Search ..... 15/144.4, 244.1–244.3, 15/228; 604/1; D32/40, 51, 52

[56] References Cited

U.S. PATENT DOCUMENTS

| | | | |
|---|---|---|---|
| 247,616 | 9/1881 | Coles | 15/244.1 |
| D. 304,630 | 11/1989 | Jones et al. | D32/40 |
| D. 312,156 | 11/1990 | Dowlat | D32/51 |
| D. 312,339 | 11/1990 | Nero, III | D32/51 |
| 484,422 | 10/1892 | Gunn | 15/244.1 |
| 843,590 | 2/1907 | Dunn, Jr. et al. | 15/144.4 |
| 1,462,794 | 7/1923 | Kimpunen | 15/228 |
| 1,577,944 | 3/1926 | Bennington | 15/244.1 |
| 1,951,023 | 3/1934 | Josselyn | 15/144.4 |
| 2,237,793 | 4/1944 | Rudd | 15/244.1 |
| 2,691,788 | 10/1954 | Thomasson | 15/244.1 |
| 2,694,213 | 11/1954 | Thomasson | 15/244.1 |
| 2,735,129 | 2/1956 | Lorenz | 15/244.1 |
| 3,058,139 | 10/1962 | Dryden | 15/244.1 |
| 3,188,675 | 6/1965 | Beck | 15/144.4 |
| 3,317,944 | 5/1967 | Napier, Sr. et al. | 15/244.1 |
| 3,319,281 | 5/1967 | Montgomery | 15/244.1 |
| 3,407,424 | 10/1968 | Lanzarone et al. | 15/144.4 |
| 3,491,397 | 1/1970 | Hesener | 15/118 |
| 4,135,274 | 1/1979 | Freeman | 15/244.1 |
| 4,190,922 | 3/1980 | Elias | 15/244.2 |
| 4,503,579 | 3/1985 | Nicely | 15/244.2 |
| 4,819,294 | 4/1989 | Calvert | 15/209.1 |
| 5,033,155 | 7/1991 | Klotz | 15/244.3 |
| 5,088,148 | 2/1992 | Hernandez | 15/228 |
| 5,235,717 | 8/1993 | Lanzo, Jr. et al. | 15/97.1 |

FOREIGN PATENT DOCUMENTS

| | | | |
|---|---|---|---|
| 1224005 | 7/1987 | Canada | 15/228 |
| 1219860 | 12/1959 | France | 15/244.1 |
| 422405 | 12/1925 | Germany | 15/244.1 |

OTHER PUBLICATIONS

Translation of French Patent #1,219,860.

*Primary Examiner*—Mark Spisich

*Attorney, Agent, or Firm*—Baker & Botts

[57] ABSTRACT

A cleaning utensil (10) is disclosed which comprises a handle (12). Handle (12) comprises telescoping handle portions (14) and (16). Handle portion (16) is fixed to a semi-rigid endcap (32) which is fixed to a spherical waved-surface sponge (34).

11 Claims, 1 Drawing Sheet

CLEANING UTENSIL

CROSS REFERENCE TO RELATED APPLICATION

This application is a continuation of application Ser. No. 08/146,799 filed Nov. 1, 1993, now abandoned.

TECHNICAL FIELD OF THE INVENTION

This invention relates in general to the field of cleaning utensils and more particularly to an improved cleaning utensil comprising a telescoping handle and a spherical waved-surface sponge.

BACKGROUND OF THE INVENTION

Items used for cleaning surfaces vary widely in their construction and convenience. For example, combinations of pivoting rectangular sponges on handles of various length have been used to some effect in cleaning surfaces in a variety of contexts. However, such combinations are difficult to use on highly varying surfaces and in cramped quarters. Similarly, simple sponges and scrubbing pads are useful on widely varying surfaces but require the user to be in difficult body positions such as bending and being on hands and knees.

Accordingly, a need has arisen for an improved cleaning utensil that allows for the cleaning of widely varying surfaces in closed quarters in a convenient manner.

SUMMARY OF THE INVENTION

In accordance with the teachings of the present invention, a cleaning utensil is provided that substantially reduces or eliminates disadvantages associated with prior art cleaning systems.

According to one embodiment of the present invention, a cleaning utensil is provided which comprises a telescoping handle which includes a plurality of handle portions that are selectably fixed with respect to one another. The telescoping handle is fixed to a spherical sponge through a semi-rigid end cap.

BRIEF DESCRIPTION OF THE DRAWINGS

A more complete understanding of the present invention may be acquired by referring to the attached FIG. 1 which is a schematic illustration of the cleaning utensil constructed according to the teachings of the present invention.

DETAILED DESCRIPTION OF THE INVENTION

Figure 1:
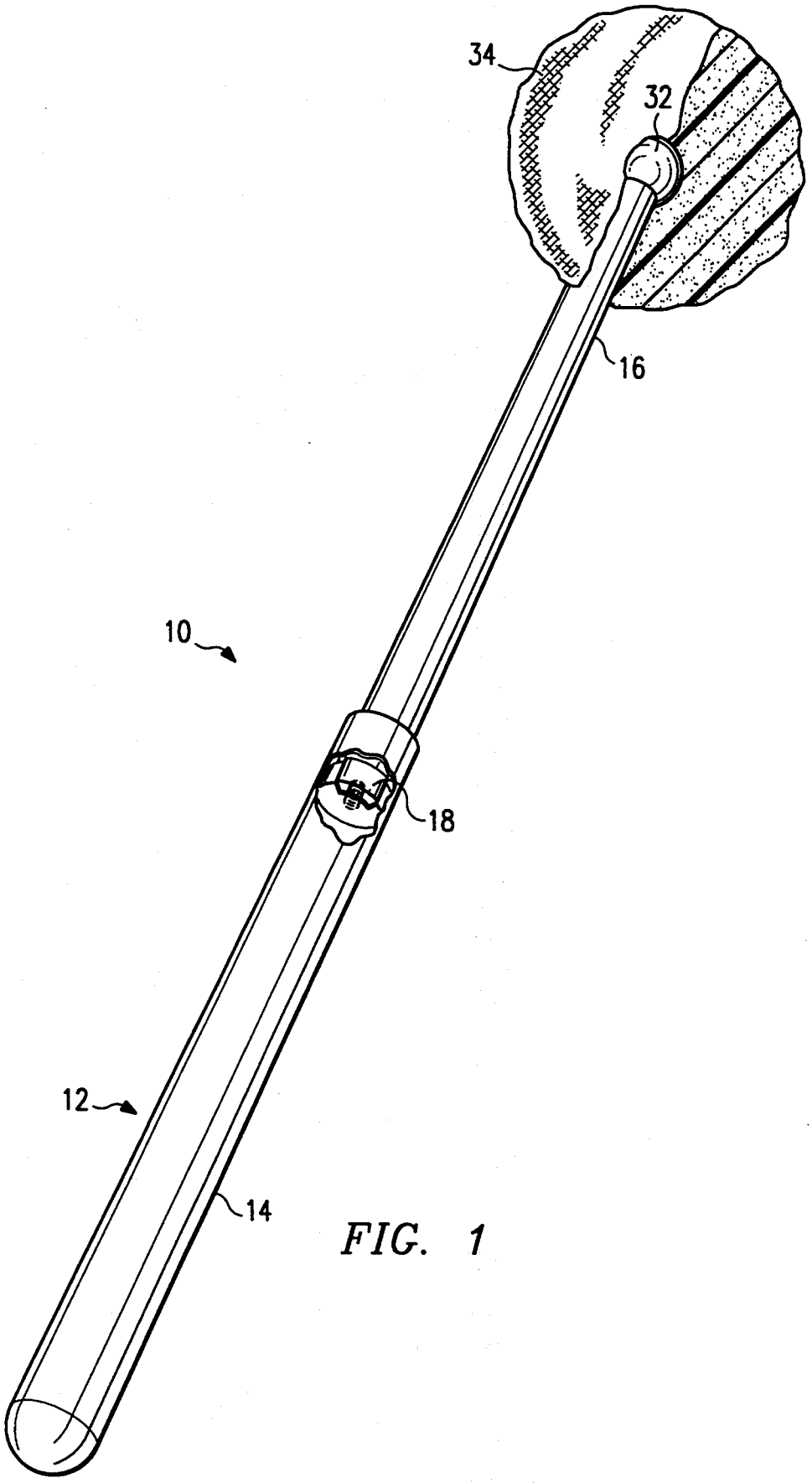

Referring to FIG. 1, a cleaning utensil 10 is shown. Cleaning utensil 10 comprises a handle 12 which comprises first handle portion 14, and second handle portion 16. Handle 12 is telescoping in that the radius of second handle portion 16 is sufficiently small so that it will fit within the interior of first handle portion 14.

Handle portions 14 and 16 comprise cylindrical pipes which may be constructed of lightweight rigid material such as plastic or fiberglass. The handle portions 14 and 16 simply have to be twisted to lengthen or shorten and retwisted to hold at your desired position. The handle portions may be fixed with respect to another by using a conventional spring-loaded eccentric 18 coupled to the end of handle portion 16 disposed within handle portion 14.

Cleaning utensil 10 further comprises a substantially spherical semi-rigid endcap 32 fixed to the distal end of second handle portion 16. Endcap 32 may comprise, for example, a soft rubber or plastic. Cleaning utensil 10 further comprises a spherical waved-surface sponge 34 which is fixed to endcap 32. Sponge 34 may comprise a sponge which may comprise, for example, a man-made material such as nylon or a suitably-shaped natural sponge. Sponge 34 is spherical in shape and comprises a waved-surface to enable it to clean widely varying surfaces such as corners and tight curves. Sponge 34 is fixed with respect to handle 12 to allow for vigorous scrubbing of surfaces to be cleaned.

Endcap 32 functions to prevent the end of handle portion 16 from scratching surfaces to be cleaned in the event that sponge 34 is deformed or torn to such a degree as to expose the end of handle portion 16. Endcap 32 may be removably fixed to handle portion 16 to allow for removal and replacement of endcap 32 and sponge 34. Accordingly, handle 12 can be used with many sponges such as replacement sponges or sponges having various shapes. Sponge 34 is shown in FIG. 1 in cross-section to show endcap 32 and the hidden portions of handle portion 16. In actual construction, sponge 34 completely surrounds and is attached to endcap 32 and encases the end portion of handle portion 16.

Although the present invention has been described in detail, it should be understood that various changes, substitutions and alterations may be made to the utensil described herein without departing from the spirit and scope of the present invention which is solely defined by the appended claims.

What is claimed is:

1. A cleaning utensil, comprising:

a straight telescoping handle comprising a plurality of handle portions;

a substantially spherical semi-rigid endcap fixed with respect to and abutting an end of one of said handle portions which is softer and less rigid than the handle portions, said semi-rigid endcap preventing said end of said one of said handle portions from scratching surfaces to be cleaned in the event said end of said one of said handle portions is exposed; and a spherical sponge fixedly attached to said semi-rigid endcap such that said spherical sponge does not pivot or rotate with respect to said handle, said spherical sponge surrounding said semi-rigid endcap and encasing the adjacent portions of said end of said one of said handle portions.

2. The cleaning utensil of claim 1 and further comprising means for fixating said handle portions in a contracted configuration.

3. The cleaning utensil of claim 1 wherein said sponge comprises a natural sponge.

4. The cleaning utensil of claim 1 wherein said sponge comprises a man-made sponge.

5. The cleaning utensil of claim 1 wherein said handle comprises two handle portions.

6. The cleaning utensil of claim 1 wherein said handle portions comprises plastic.

7. The cleaning utensil of claim 1 wherein said handle portions comprise fiberglass.

8. The cleaning utensil of claim 1 wherein said sponge comprises a waved surface.

9. The cleaning utensil of claim 1 wherein said endcap and said sponge are operable to be removed from said handle.

10. The cleaning utensil of claim 1 and further comprising means for fixing the handle portions in an extended configuration.

11. A cleaning utensil, comprising:

a straight telescoping handle comprising a plurality of handle portions;

a substantially spherical semi-rigid endcap fixed to and abutting an end of one of said handle portions which is softer and less rigid than the handle portions, said semi-rigid endcap preventing said end of said one of said handle portions from scratching surfaces to be cleaned in the event said end of said one of said handle portions is exposed;

a spherical waved-surface sponge fixedly attached to said semi-rigid endcap such that said spherical sponge does not pivot or rotate with respect to said handle, said spherical sponge surrounding said semi-rigid endcap and encasing the adjacent portions of said end of said one of said handle portions;

means for fixing said handle portions of the cleaning utensil in an extended configuration; and means for fixing said handle portions in a contracted configuration.

* * * * *